United States Patent [19]

Björn et al.

[11] 4,003,137

[45] Jan. 18, 1977

[54] METHOD OF DRYING WET POWDER

[75] Inventors: Lars-Erik Björn; Mats Jurgen Martin Olsson, both of Karlskoga, Sweden

[73] Assignee: AB Bofors, Bofors, Sweden

[22] Filed: Oct. 1, 1974

[21] Appl. No.: 510,876

[30] Foreign Application Priority Data

Oct. 1, 1973 Sweden ..... 7313296

[52] U.S. Cl. ..... 34/25; 34/28; 34/29; 34/46; 34/103

[51] Int. Cl.[2] ..... F26B 3/14

[58] Field of Search ..... 34/22, 26, 31, 46, 48, 34/56, 72, 77, 103, 50, 28, 29, 25, 33, 34, 32; 260/223

[56] References Cited

UNITED STATES PATENTS

| | | | |
|---|---|---|---|
| 1,711,574 | 5/1929 | Miller | 34/46 |
| 2,098,024 | 11/1937 | Bailey | 34/79 |
| 3,092,472 | 6/1963 | Figley | 34/56 |
| 3,218,313 | 11/1965 | Blankenship | 260/223 |
| 3,266,165 | 8/1966 | Apostle et al. | 34/79 |
| 3,526,969 | 9/1970 | Alms et al. | 34/56 |
| 3,600,820 | 8/1971 | Klein | 34/48 |
| 3,849,901 | 11/1974 | Sietmann et al. | 34/56 |

*Primary Examiner*—John J. Camby
*Assistant Examiner*—Larry I. Schwartz
*Attorney, Agent, or Firm*—Pollock, Vande Sande & Priddy

[57] ABSTRACT

Method and apparatus for drying nitrocellulose powder. The wet powder with the liquid is admitted into the upper part of a frame comprising a pair of generally parallel spaced foraminous members which are inclined at an acute angle to the horizontal. The wet powder is admitted in sufficient quantity to substantially fill the space between the members. A stream of a drying gas is directed against the upper one of the members and the dried powder is received from between the spaced members at the bottom of the frame. The liquid is removed through the apertures in the lower one of the members. Preferably, the angle of inclination of the frame is between 5° and 45° to the horizontal. The velocity of the drying gas is selected such that, in conjunction with the angle of inclination of the frame, the powder is spread as a substantially even layer over the lower one of the frame members throughout the drying of the powder.

4 Claims, 3 Drawing Figures

METHOD OF DRYING WET POWDER

The present invention relates to a method to be utilized in the drying of wet powder. The present invention also relates to a device for carrying out said method. The invention is primarily intended with use for nitrocellulose powder; specifically, for nitrocellulose-based powder made with the aid of a solvent, usually in the form of a mixture of ether and alcohol, where the final stage of the manufacture before the drying is leaching in water to remove residual solvent and possibly salt. However, other types of powder may also be dried by employing the present invention.

In order to dry such powder, it has previously been the practice to use a special drying chamber, in which large quantities of powder (up to 2000 kg) have been placed in sacks, each containing 20 kg, after which the powder, through air circulation and heating in the drying chamber, has been dried for 10–48 hours. After drying, the temperature in the chamber has been lowered and the relative humidity has been increased by admitting steam, after which it has been possible to start removing the powder from the drying chamber. It has been been necessary to proceed with great caution, owing to the large quantity of dry powder that has been concentrated in the drying area.

In order to give the dried powder the correct moisture content at this stage, it has also been the practice to add water to a minor portion of the dried powder, after which said minor portion has been mixed with the remainder of the batch. It has only thereafter been possible to package the treated powder.

The previous method has required a long drying time, rigorous safety regulations, and health risks for the personnel concerned.

The purpose of the present invention is primarily to solve these problems. The present invention utilizes the fact that the processing of a comparatively small quantity of powder involves fewer safety risks. According to the invention, the drying time required is shortened by distributing the quantity of powder being treated over a comparatively thin layer.

A characteristic of the method employed by the present invention is that the wet powder is admitted into a frame provided with perforated side parts, and thereafter air is conveyed through the powder via perforations in the side parts. A device for carrying out this method may be considered to be characterized by its comprising an inclined frame provided with perforated side parts arranged so as to permit water to run off the wet powder. Furthermore, the frame is exposed to air that passes the powder via perforations in said side parts.

Figure 1:
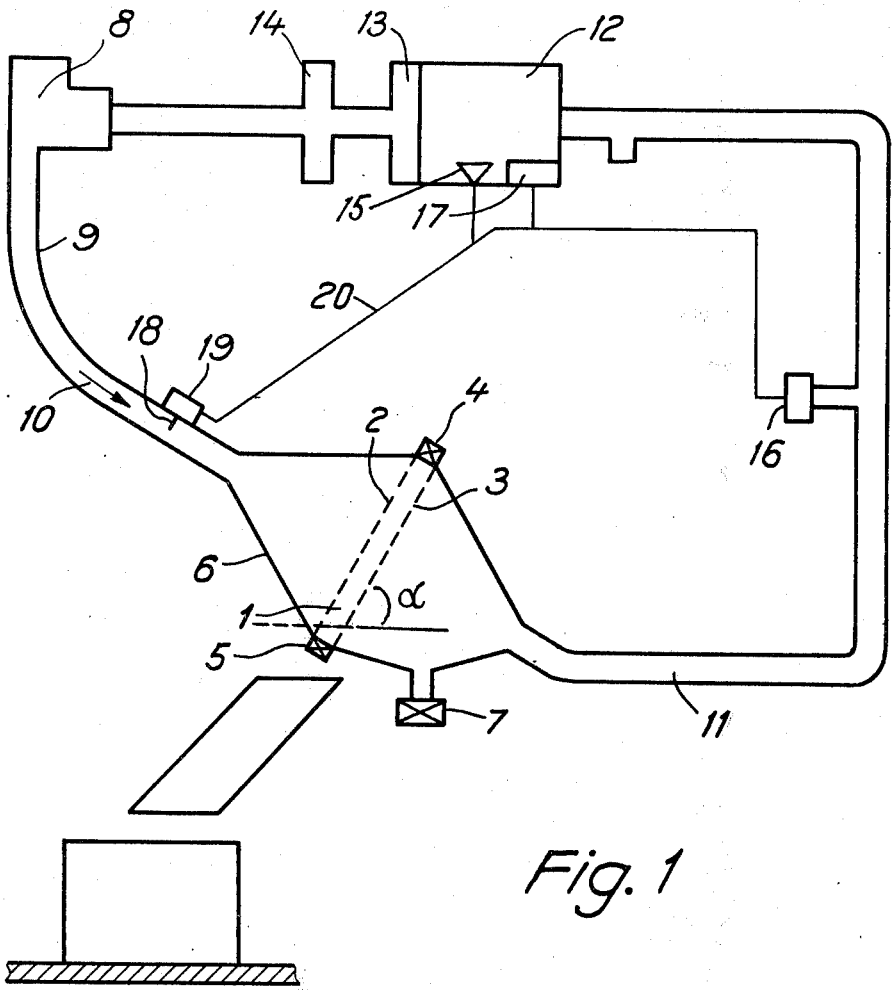
Figure 2A:
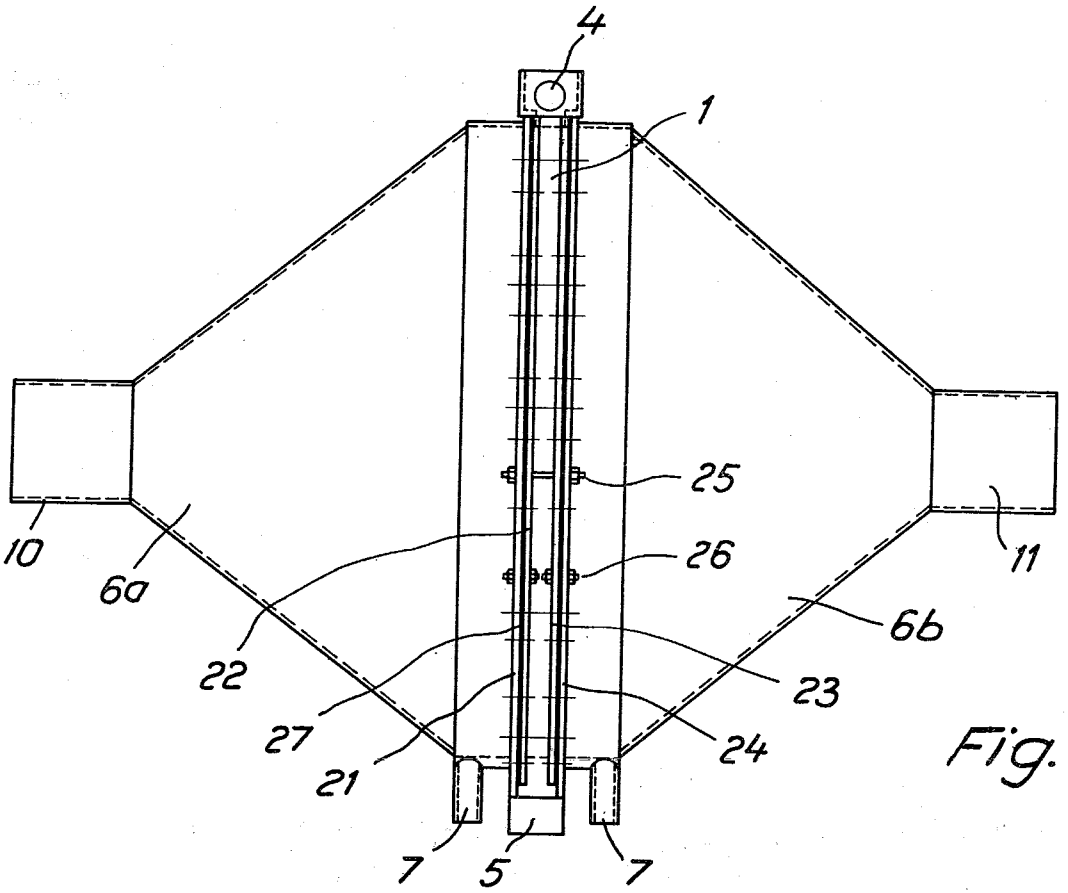
Figure 2B:
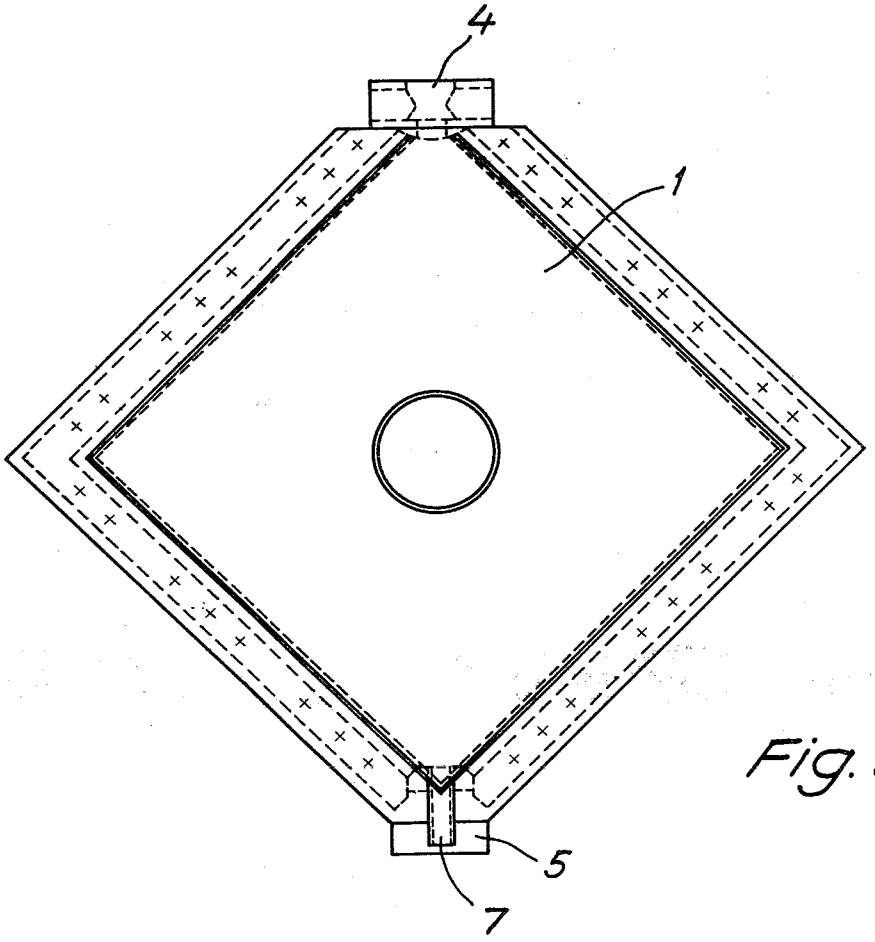

A proposed embodiment of the present invention will be described below, with reference to the attached drawings, in which: FIG. 1 shows the design, in principle, of a conditioning system utilized in conjunction with the device, and FIGS. 2*a*–2*b* are different views showing in detail the components comprising FIG. 1.

In FIG. 1, reference 1 designates a frame, viewed from one edge surface. The frame is made with perforated side parts 2 and 3. In this embodiment, the frame has a square cross section (cross section at right angles to the plane of the figure) and is supported on one of its edges with the plane (at right angles to the plane of the figure) of the side parts 2 and 3 inclined in relation to a horizontal plane crossing the frame. Said inclination depends upon, among other things, the kind of powder which is being dried, and may vary from 50° to 45°,i.e. the angle $\alpha$ in the figure is between 5° and 45°.The frame is also provided with an intake valve 4 for the wet powder together with water and an outlet valve 5 for the dried powder. The side parts are placed close to each other, in order to form a narrow slot between the parts. For nitrocellulose powder (e.g. rifle powder for 7.62 calibre rifles) said frame is intended to be able to hold an injected quantity of approx. 100 kg of powder, which quantity of powder will thus be placed between the side parts in a thin layer. For a frame with a square cross section, it is appropriate to give the side of the frame a length of 1.0 m and a distance (slot) between the side parts of 0.1 m. Depending on the kind of powder, the quantity of powder can generally vary between approx. 35 and 300 kg, with the corresponding variation of the slot between 0.05 and 0.3 m.

The frame is fastened in a drum 6, which is provided with a drain cock or a water trap 7, and the frame extends over the entire cross section (at right angles to the plane of the figure) of the drum. The drum is located in an air conditioning system which contains, among other things, a fan 8 which, via a pipe 9, blows air in the direction of the arrow 10 towards the frame, the force of the air current then being chosen in such a way that the angle of inclination used keeps the powder spread out over the entire cross section, although its volume decreases as the water is removed. On the other side of the frame, the drum is connected via a pipe 11 in turn to a mixing unit 12, a filter 13 and a heat exchanger 14, which is also connected to one of the suction intakes of the fan. In addition to said drain 7, the system has a mixing unit 12, an intake valve 15 for water, and an outlet valve 16 for releasing air with too little or too much moisture. The mixing unit 12 is provided with an intake 17 for admitting fresh air into the system. The device shown also has control members which determine the relative humidity in the circulating air when the system is closed. Said control members comprise a sensing bulb 18 which, via a converting device 19 and an electric conductor 20, control the supply of water and fresh air and the exhaust of circulated air as described in the following when the control members are activated.

The device described above functions in the following way. Wet powder, mixed with water, is injected from a container (not shown) into the frame via its intake valve 4. During the injection, a large portion of the water runs off the frame through the perforations and out into the drain 7. The perforations are, of course, designed in such a way that the powder remains in the frame. At the time of injection, the intake valve can be actuated automatically in a way familiar to the prior art. When the frame has been filled, the valve 4 is closed, the fan 8 is started; water continues to run off through the water trap 7. The air is conveyed further upwardly through the mixing unit 12, the filter 13 and the heat exchanger 14 and finally back to the fan 8. The heat exchanger then causes the air to assume a predetermined temperature, e.g. 50° C. The blowing of warm air through the powder continues for a time, the length of which depends on the quantity and kind of powder. In the present case a time of between 4 and 5 minutes has been chosen. The filter 13 will absorb any dust emanating from the powder.

At this stage, the powder has been dried to approximately the degree intended. Hereafter, during a conditioning period, the powder is processed so as to have the correct moisture content. The conditioning system is then closed. Simultaneously, the control members are activated. If, at this stage, too high a moisture content has been registered by the sensing bulb 19, this actuates the fresh air intake 17 and the outlet valve 16 so that fresh air is drawn into the system at the same time as air which is too moist is released. Likewise, if the sensing bulb detects air that has too little moisture, the intake 15 for water and the outlet valve 16 are actated in the corresponding way so that water is added and the air with too little moisture is released. During the first part of the conditioning period, the temperature of the circulating air is kept comparatively high, usually the same as during the foregoing drying period. During the latter part of the conditioning period, the temperature is lowered, (while a predetermined relative humidity is maintained), to room temperature. This is advantageous from a hygienic point of view when nitro-glycerine powder is being processed, for the powder does not dry if it lies uncovered at room temperature with the correct humidity.

After a total drying time of from 15 to 150 minutes, the frame is emptied via its drain 5 directly into a delivery package. The emptying may then be completed automatically, in ways taught by the prior art.

In FIGS. 2*a* and 2*b*, the location of the frame in the drum and the design of the frame and the drum are shown in detail. The parts corresponding to those shown in FIG. 1 have been given the same reference designations. In accordance with FIGS. 2*a* and 2*b* the inlet part 6*a*, which has the form of a pyramid, has a flange 21, the frame has two flanges 22 and 23; and the outlet part 6*b*, which also has the form of a pyramid, has a flange 24, via which flanges the frame is held together with the parts 6*a* 6*b*, respectively. The parts 6*a* and 6*b* are also fastened to one another. For purposes of fastening the pieces together, bolts 25 and 26, or screws extending through the respective flanges, are used. These are positioned with uniform spacing along the periphery. At the point where the bolts or screws are located, the frame is sealed against the respective cone with a sealing strip 27 of an appropriate kind. In FIGS. 2*a* and 2*b*, said water trap is not shown in detail, the water trap not being a part of the present invention.

A method utilized for the drying of powder using the devices described above is characterized by the wet powder being admitted into a frame provided with perforated or foraminous with side parts with the air thereafter conveyed through the powder via the perforations in the side parts. In one embodiment, the frame is provided with an intake which permits injection of the wet powder together with water into the frame. In a further development of the concept of this invention, the frame is located in an air conditioning system in which air which has not been heated, dry air which has been heated, and air with the correct relative humidity and different temperature, is conveyed through the powder according to a predetermined schedule. In order to achieve entirely automatic production, the new method may also utilize an outlet valve on the frame so that the dried powder may run out of the frame and may be transferred to delivery packaging. Injection of the wet powder together with the water will then be completed automatically. The activation of the intake valve 4 will likewise be carried out automatically.

This invention is not limited to the embodiment described above, but is subject to modification within the scope of the following claims. Thus, for example, the cross section of the frame need not be square, but may be hexagonal, or it may have the form of some other appropriate figure. Furthermore, the injection of the powder into the frame may take place with air instead of with water.

We claim:

1. A method for the drying of nitrocellulose powder comprising the steps of:

a. admitting the wet powder with liquid into the upper part of a frame comprising a pair of generally parallel spaced foraminous members which are inclined at an acute angle to the horizontal, the wet powder being admitted in sufficient quantity to substantially fill the spaces between the members;
b. directing a stream of a drying gas against the upper one of said members;
c. receiving the dried powder from between the spaced members at the bottom of the frame;
d. removing the liquid through the apertures in the lower one of said members;
e. selecting the angle of inclination of the frame to be between 5° and 45° to the horizontal;
f. selecting the velocity of the drying gas such that in conjunction with the selected said angle of inclination the powder is spread on a substantially even layer over the lower one of said frame members throughout the drying of the powder.

2. The method of claim 1, wherein the drying gas is at a temperature of about 50° C.

3. The method of claim 1 wherein the temperature and humidity of the drying gas is controlled.

4. The method of claim 2 wherein the temperature of the drying gas is subsequently lowered to room temperature.

* * * * *